US005584710A

United States Patent [19]

Koshikawa et al.

[11] Patent Number: 5,584,710

[45] Date of Patent: Dec. 17, 1996

[54] ELECTRICAL CONNECTOR ASSEMBLY

[75] Inventors: Kiyoshi Koshikawa; Shuichi Kotaki, both of Mito; Takeshi Konno, Ibaraki-ken, all of Japan

[73] Assignee: Mitsumi Electric Co., Ltd., Tokyo, Japan

[21] Appl. No.: 382,232

[22] Filed: Jan. 31, 1995

[30] Foreign Application Priority Data

Jan. 31, 1994 [JP] Japan ..... 6-29007

[51] Int. Cl.$^6$ ..... H01R 13/44; H01R 13/453

[52] U.S. Cl. ..... 439/138

[58] Field of Search ..... 439/188, 136, 439/137, 138, 140, 142, 181

[56] References Cited

U.S. PATENT DOCUMENTS 4,929,183 5/1990 Rinneburger ..... 439/67

5,002,495 3/1991 Tanaka ..... 439/138

5,306,163 4/1994 Asakawa ..... 439/607

*Primary Examiner*—Gary F. Paumen

*Assistant Examiner*—T. C. Patel

*Attorney, Agent, or Firm*—Morrison Law Firm

[57] ABSTRACT

An electrical connector includes a plurality of flexible convoluted metal contact strips connectable to external circuits. Switch arms connected to external circuits in a portable unit have a conductive contact area for selectively engaging the contact strips, thereby connecting the base unit and portable unit. A cover on the connector body rotates under pressure from the switch arm to direct excess force from the switch arm around the connector. The range of rotation of the cover is limited under contact of a plurality of stoppers by contact between the cover and a fixed plate. In this manner, excess force from the switch arm is never applies directly to the connector body or underlying connections.

10 Claims, 5 Drawing Sheets

ELECTRICAL CONNECTOR ASSEMBLY

BACKGROUND OF THE INVENTION

The present invention relates to an electrical connector. More specifically, the present invention relates to an electrical connector with a movable cover which transfers external force applied to the connector about the main connector body.

Electrical connectors are used in electronic devices to connect a base unit and a portable unit. A typical example is a removable car radio, which consists of a base unit installed in the car and a portable receiver unit which can be removed at night. When separated, neither unit is operable, thereby discouraging theft. When reconnected, electrical connectors in the base unit connect to circuits in the portable unit.

Referring to FIG. 7, an electrical connector according to the prior art is shown generally at 50. A connector body 52 supports a plurality of convoluted conductive contact strips 54 (only one of which is shown). Contact strips 54 are substantially parallel and separated by non-conductive portions of connector body 52. Each contact strip 54 has a first section 54*a* connected to a printed circuit board 70 by a solder connection 90. A second section 54*s* of each contact strip 54 protrudes through an opening 52*a* in the side of connector body 52.

For each contact strip 54, a portable unit (not shown) has a corresponding switch arm 60. Switch arm 60 has a conductive contact area 64 which selectively engages second section 54*s* of contact strip 54 such that the portable unit electrical connects with the base unit. An engagement means (not shown) maintains contact between contact area 64 and second section 54*s*.

A drawback of the above prior art is that pressure applied by switch arm 60 to contact strip 54 is usually greater than necessary to establish electrical contact between contact portion 64 and contact strip 54. For example, when pressing a button in a car radio, a user exerts several pounds of pressure in excess of that necessary to trigger the desired function. As a result, a front end of switch arm 60 transfers the excess force to connector body 52, straining the connection with circuit board 70 at solder connection 90. Over time, under the repeated stress, solder connection 90 may crack or the circuit pattern may peel off circuit board 70.

One prior art attempt to overcome this drawback uses a tilt prevention plate 80 as a buffer against external force. Tilt prevention plate 80 is usually a fixed surface within which the base unit is installed. In theory, if connector body 52 is placed flush against a solid surface, then excess force cannot move connector body 52 or otherwise strain solder connection 90. For example, in the case of a car radio, tilt prevention plate 80 could be the rear of the well in which the radio is installed.

A drawback of the above solution is that, in practice, connector body 52 cannot be installed flush against tilt prevention plate 80. Thus, even with tilt prevention plate 80, excessive force from switch arm 60 moves connector body 52 an offset distance L between connector 50 and tilt prevention plate 80. Thus, while tilt prevention plate reduces stress on solder connection 90 and prolongs the life of the connector, it fails to prevent the effects of long term use.

OBJECTS AND SUMMARY OF THE INVENTION

It is accordingly an object of the present to overcome the drawbacks of the prior art.

A further object of the present invention is to provide an electrical connector which does not move under pressure from a switch arm.

A still further object of the present invention is to provide an electrical connector with a cover which transfers external pressure onto a fixed point.

Briefly stated, the present invention provides an electrical connector in which a plurality of flexible convoluted metal contact strips are connectable to external circuits. Switch arms connected to external circuits in a portable unit have a conductive contact area for selectively engaging the contact strips, thereby connecting the base unit and portable unit. A cover on the connector body rotates under pressure from the switch arm to direct excess force from the switch arm around the connector. The range of rotation of the cover is limited under contact of a plurality of stoppers by contact between the cover and a fixed plate. In this manner, excess force from the switch arm is never applies directly to the connector body or underlying connections.

According to an embodiment of the invention, there is provided an electrical connector, comprising: a socket, means for mounting the socket to a chassis, a cover mounted movably on the socket, an opening in the cover, a contact mounted in the socket, the contact having a first section connected to external circuits and a second section protruding through the opening, means for selectively engaging the second section, and the cover having a stopper which engages the chassis when the means for selectively engaging engages the second section.

According to a feature of the invention, there is provided an electrical connector, comprising: a socket, means for mounting the socket to a chassis, a plurality of conductive contacts in the socket, the socket having non-conductive portions disposed between adjacent ones of the plurality of conductive contacts, a cover mounted movably on the socket, a plurality of openings in the cover, each of the plurality of conductive contacts having a first section connected to external circuits and a second section protruding through respective ones of the plurality of openings in the cover, a plurality of conductive means for selectively engaging the plurality of conductive contacts at the second section, and the cover having a stopper which engages the chassis when the conductive means engages the second section.

According to a further feature of the invention, there is provided an electrical connector, comprising: a portable unit having a plurality of switch arms, a base unit, a plurality of conductive contacts mounted in the base unit, a cover mounted movably on the base unit and having a plurality of openings, each of the plurality of conductive contacts having a first section connected to external circuits and a second section protruding through respective ones of the plurality of openings in the cover, the plurality of switch arms being disposed in the portable unit to selectively engage the plurality of conductive contacts at the second section, and the cover having a stopper which engages a fixed surface when the one of the plurality of switch arms engages the second section.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
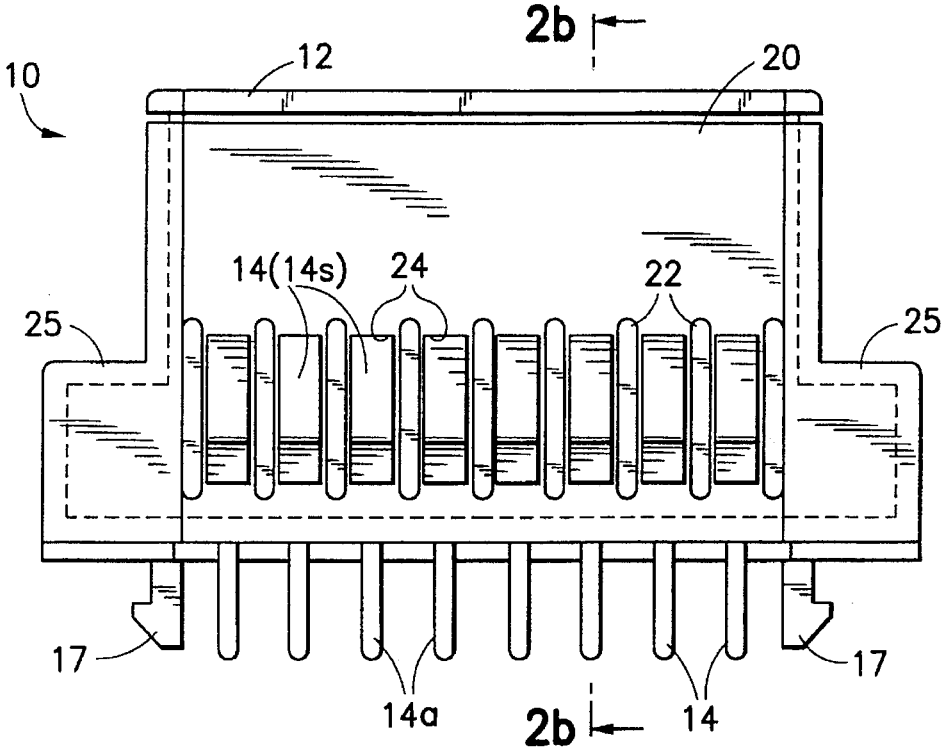
FIG. 1 is a front view of an electrical connector according to a preferred embodiment of the present invention.
Figure 2A:
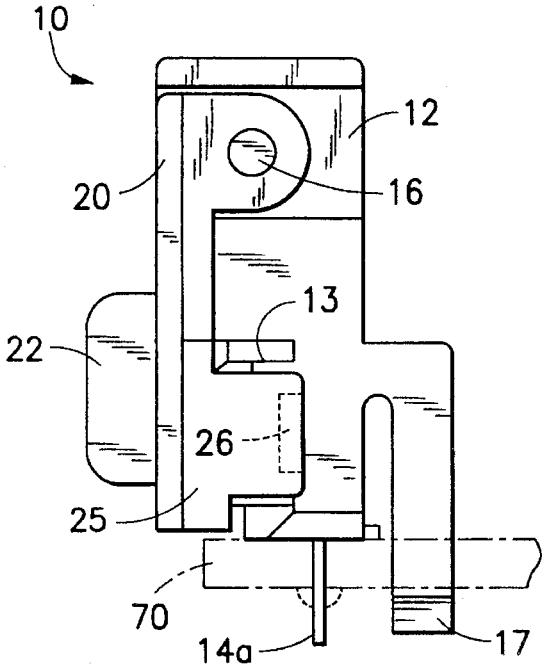
FIG. 2*a* is a side view of an electrical connector according to the embodiment of FIG. 1.
Figure 2B:
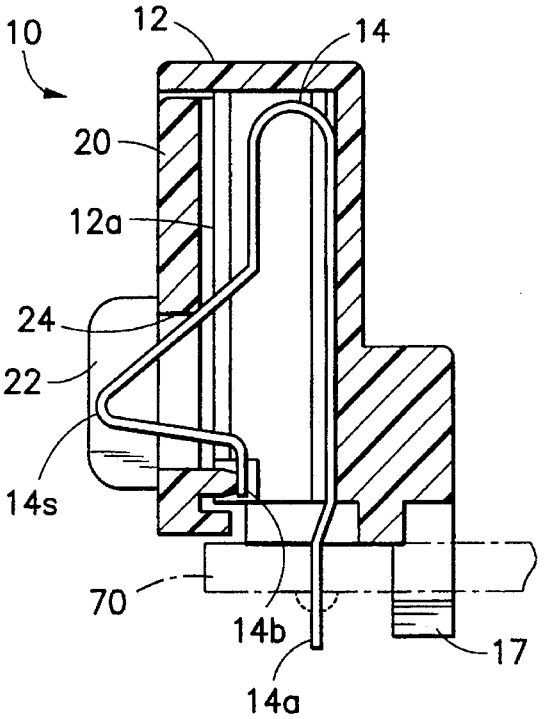
FIG. 2*b* is a cross-section side view of an electrical connector according to the embodiment of FIG. 1.

Referring to FIGS. 1 and 2*a*–2*b*, an electrical connector according to the present invention is shown generally at 10. A socket connector body 12, made of any appropriate material such as for example, molded plastic, carries a plurality of conductive convoluted metal strips 14. A positioning projection 17 affixes connector body 12 to an underlying printed circuit board 70. A cover 20 is mounted rotatably on connector body 12 by a shaft 16 on each side of connector body 12. Two stoppers 25 are disposed at the lower end of each side of cover 20.

Each contact strip 14 has a base end 14*a* suitable for being affixed to a circuit board 70 by a solder connection 30 and a free end 14*b* having a bent portion 14*s*. Bent portion 14*s* projects outward beyond a front 12*a* of connector body 12 and through an aperture 24 of cover 20. Each pair of adjacent apertures 24 is separated by a non-conductive projection plate 22.

The convoluted shape of contact strip 14 functions as a spring to provide an outward resiliency against the edge of aperture 24, thereby biasing cover 20 clockwise about shafts 16. The range of clockwise motion is defined by the point at which engagement projections 26 of stoppers 25 engage engagement pieces 13 on both sides of connector body 12.

Figure 4:
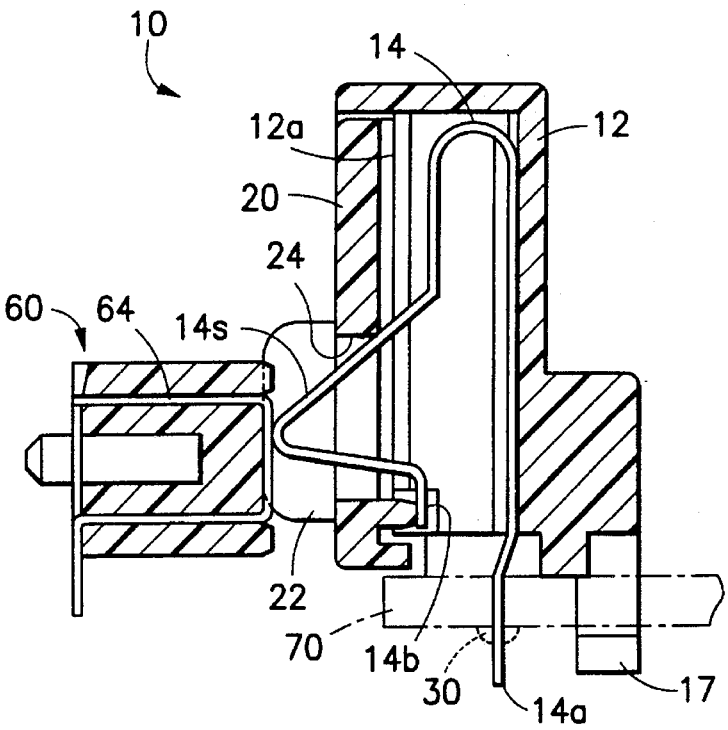
FIG. 4 is a cross-section side view showing according to the embodiment of FIG. 1, in a first operational position.
Figure 5:
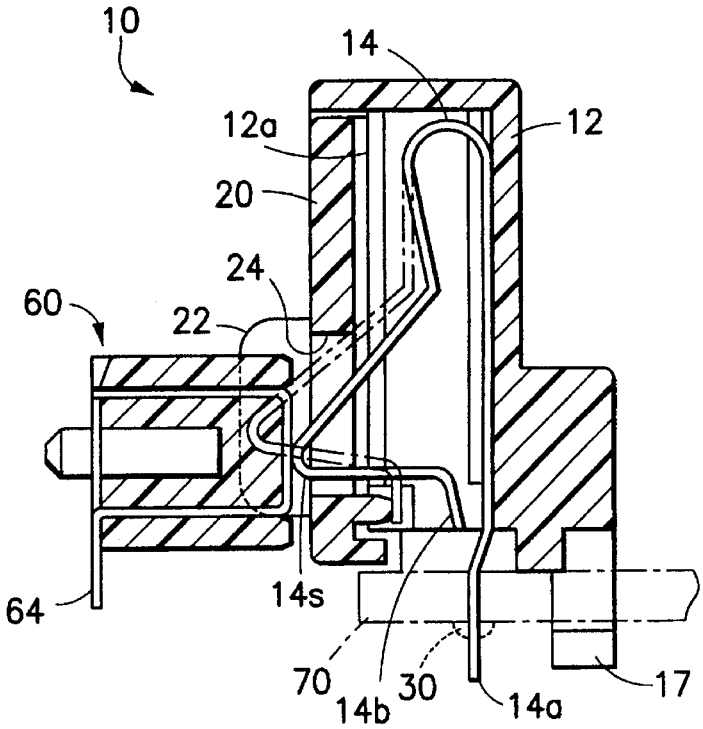
FIG. 5 is a cross-section side view according to according to the embodiment of FIG. 1, in a second operational position.

Referring now to FIG. 4, a switch arm 60, which is preferably a part of a conventional plug-type connector is provided for each contact strip 14. Switch arm 60 has a conductive contact area 64 which connects to external circuits. When switch arm 60 is pressed toward connector 10, contact area 64 connects with bent portion 14*s* of contact strip 14, establishing electrical connection between circuit board 70 and the external circuits attached to contact area 64. Further pressure against contact strip 14 flexes it from the shape shown in FIG. 4 to the shape shown in FIG. 5.

Figure 3A:
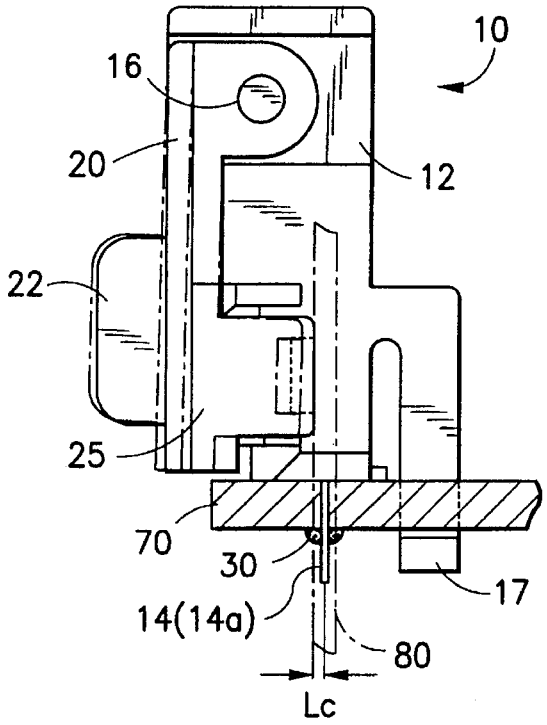
FIG. 3*a* is a side view of an electrical connector according to the embodiment of FIG. 1.
Figure 3B:
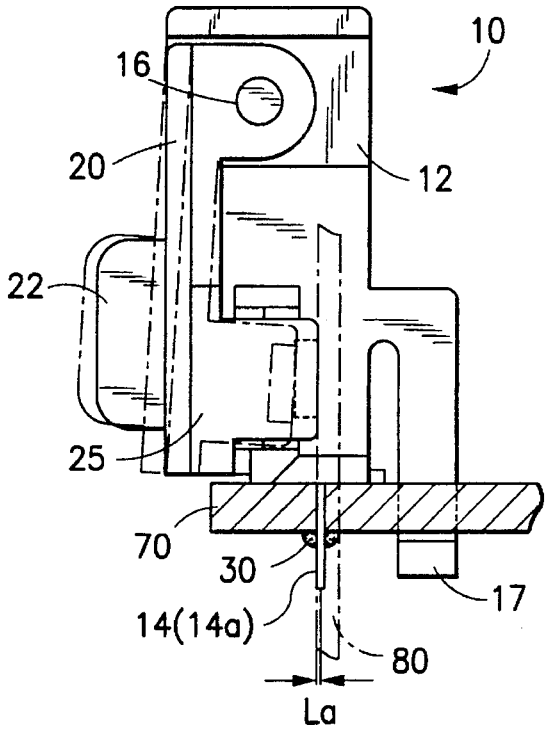
FIG. 3*b* is a side view of an electrical connector according to the embodiment of FIG. 1.
Figure 3C:
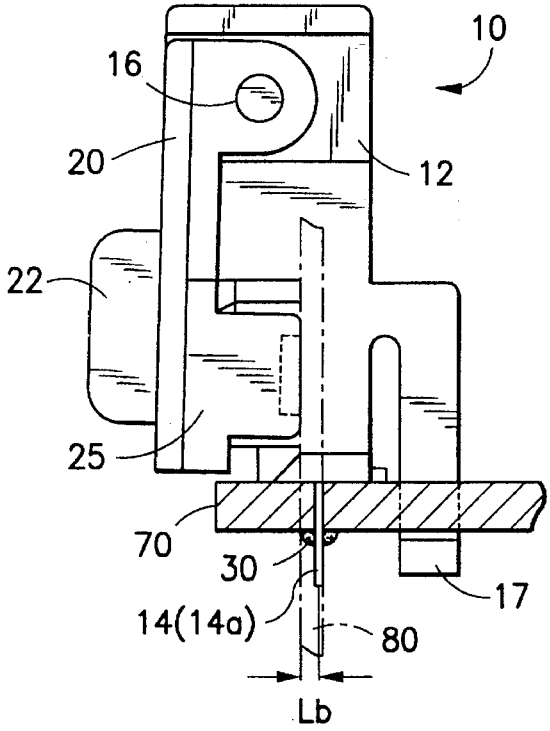
FIG. 3*c* is a side view of an electrical connector according to the embodiment of FIG. 1.

Referring now to FIGS. 3*a*–3*c*, if switch arm 60 continues to depress contact strip 14, the front end of switch arm 60 eventually contacts cover 20 such that further depression rotates cover 20 counter-clockwise about shafts 16. The range of counter-clockwise motion is limited at the point at which stoppers 25 contact a tilt prevention plate 80. Tilt prevention plate 80 prevents further rotation of cover 20, or corresponding movement in switch arm 60. Since cover 20 is mounted rotatably with respect to connector body 12, any force applied by switch arm 60 simply rotates cover 20 about shafts 16 without placing any stress on connector body 12 or solder connection 30.

When cover 20 reaches the limit of counter-clockwise motion (stoppers 25 engage tilt prevention plate 80), any additional force is transmitted directly onto tilt prevention plate 80. Since tilt prevention plate 80 is fixed, the force applied by switch arm 60 does not affect either connector body 12 or solder connection 30.

Mounting the present invention in a chassis, results in a varying offset distance between the front edge of tilt prevention plate 80 and base end 14*a* of contact strip 14.

FIG. 3*a* shows the optimal positioning of the tilt prevention plate 80 relative to the center line of base end 14*a* of contact strip 14. At this position, the two are separated by an offset distance Lc of approximately 0.5 mm.

FIG. 3*b* shows the maximum offset to the right of tilt prevention plate 80 relative to the center line of base end 14*a* of contact strip 14. At this position, the two are separated by an offset distance La of approximately 0.2 mm.

FIG. 3*c* shows the maximum offset to the left of tilt prevention plate 80 relative to the center line of base end 14*a* of contact strip 14. At this position, the two are separated by an offset distance Lb of approximately 0.8 mm.

Unlike the prior art, the present invention does not experience any adverse effects from offset distance. To the contrary, the relative location of tilt prevention plate 80 limits only the range of counter-clockwise motion of cover 20. Force applied by switch arm 60 either rotates cover 20 or transmits force directly to plate 80 without straining the connection between contact strip 14 and circuit board 70.

Figure 6A:
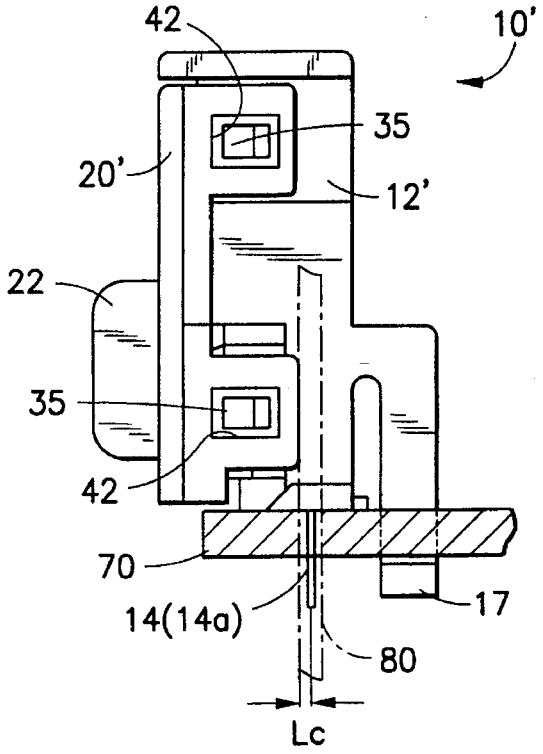
FIG. 6*a* is a cross-section side view according to another embodiment of the present invention.
Figure 6B:
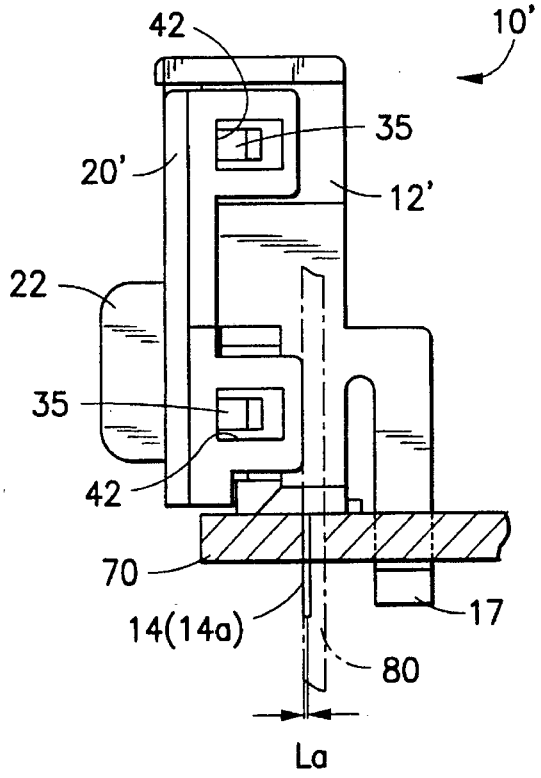
FIG. 6*b* is a cross-section side view according to the embodiment of FIG. 6*a*.
Figure 6C:
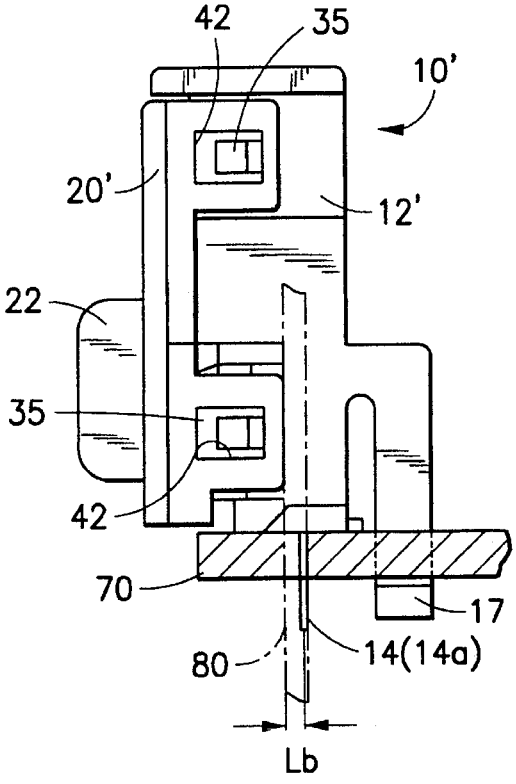
FIG. 6*c* is a cross-section side view according to the embodiment of FIG. 6*a*.
Figure 7:
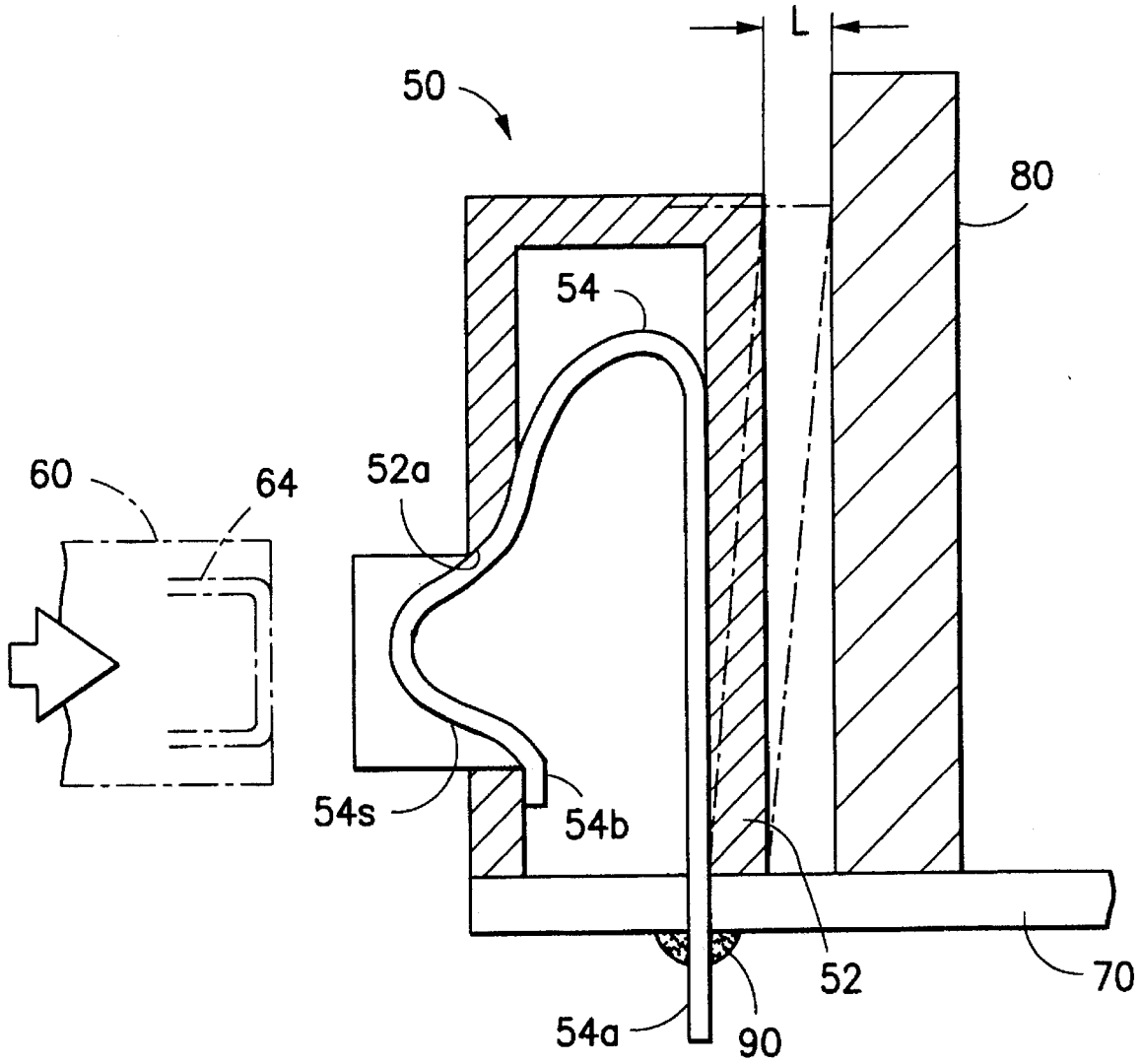
FIG. 7 PRIOR ART
FIG. 7 is a cross-section side view of an electrical connector according to the prior art.

Referring now to FIGS. 6*a*–*c*, another embodiment of the present invention is shown generally at 10'. Cover 20' is slidably mounted on connector body 12' by a pair of guide projections 35 which engage slots 42 in cover 20'. The outer frame of cover 20' around slot 42 acts as a stopper which engages tilt prevention plate 80 upon application of excessive pressure. Connector 10' thus operates in the same manner as connector 10, save that cover 20' moves linearly along connector body 12'.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

For example, a variety of different electrical components may be used as switch arm 60. Specifically, switch arm 60 could be manually or mechanically actuated.

In another example, contact portion 64 may be a separate lead disposed between the front edge of switch arm 60 and contact strip 14. When switch arm 60 moves, it pushes contact portion 60 into electrical contact with contact strip 14.

In still another example, contact strip 14 may have a variety of different shapes and convolutions, provided that the contact maintains outward resiliency.

In still a further example, contact strip 14 may serve as an independent push button switch. In this case, switch arm 60 would simply transfer force, and is not necessarily connected to external circuits. For example, switch arm 60 could be a push button on a car radio. Depression of the button would cause the switch to engage while cover 20 rotates to direct excess force away from the internal switch elements.

What is claimed is:

1. An electrical connector assembly, comprising:

a socket connector body;

a cover mounted movably on said socket connector body;

said cover having an opening therein;

at least one contact mounted in said socket connector body;

said at least one contact having a first section for connection to external circuits and a second section protruding through said opening;

means for selectively engaging said second section; and a stopper on said cover which abuts a discrete tilt prevention plate when lateral force is applied to said cover effective for preventing excessive movement of said cover.

2. Apparatus according to claim 1, wherein said cover is rotatably mounted on said socket connector body.

3. Apparatus according to claim 1, wherein said cover is slidably mounted on said socket connector body.

4. Apparatus according to claim 1, wherein said at least one contact is conductive.

5. An electrical connector assembly, comprising:

a socket connector body;

a plurality of conductive contacts in said socket connector body;

said socket connector body having non-conductive portions disposed between adjacent ones of said plurality of conductive contacts;

a cover mounted movably on said socket connector body;

a plurality of openings in said cover;

each of said plurality of conductive contacts having a first section for connecting to external circuits and a second section protruding through respective ones of said plurality of openings in said cover;

a plurality of conductive means for selectively engaging said plurality of conductive contacts at said second section; and said cover having a stopper which abuts a tilt prevention plate when lateral force is applied to said cover effective for preventing excessive movement of said cover.

6. Apparatus according to claim 5, wherein said cover is rotatably mounted on said socket connector body.

7. Apparatus according to claim 5, wherein said cover is slidably mounted on said socket connector body.

8. An electrical connector, comprising:

a portable unit having a plurality of switch arms;

a base unit;

a plurality of conductive contacts mounted in said base unit;

a cover mounted movably on said base unit and having a plurality of openings;

each of said plurality of conductive contacts having a first section for connecting to external circuits and a second section protruding through respective ones of said plurality of openings in said cover;

said plurality of switch arms being disposed in said portable unit to selectively engage respective ones of said plurality of conductive contacts at said second sections; and said cover having a stopper which abuts a discrete fixed surface when at least one of said plurality of switch arms engages a respective one of said second sections.

9. Apparatus according to claim 8, wherein said cover is rotatably mounted on said base unit.

10. Apparatus according to claim 8, wherein said cover is slidably mounted on said base unit.

* * * * *